US009427025B2

(12) United States Patent
Liu

(10) Patent No.: US 9,427,025 B2
(45) Date of Patent: Aug. 30, 2016

(54) ELECTRONIC CIGARETTE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 470 days.

(21) Appl. No.: 14/030,644

(22) Filed: Sep. 18, 2013

(65) Prior Publication Data

US 2015/0027461 A1 Jan. 29, 2015

(30) Foreign Application Priority Data

Jul. 25, 2013 (CN) ..... 2013 2 0447830

(51) Int. Cl.
*A24F 47/00* (2006.01)

(52) U.S. Cl.
CPC ..... *A24F 47/008* (2013.01)

(58) Field of Classification Search
USPC ..... 131/225
See application file for complete search history.

(56) References Cited

U.S. PATENT DOCUMENTS

2009/0095310 A1* 4/2009 Chaoui ..... A24F 1/30 131/173
2010/0031968 A1* 2/2010 Sheikh ..... A24F 47/008 131/347
2012/0174935 A1* 7/2012 Steinberg ..... A24F 1/32 131/329
2013/0192619 A1* 8/2013 Tucker ..... H01C 17/00 131/329

* cited by examiner

*Primary Examiner* — Michael H Wilson
*Assistant Examiner* — Eric Yaary
(74) *Attorney, Agent, or Firm* — Tim Tingkang Xia, Esq.; Locke Lord LLP

(57) ABSTRACT

This present invention relates to the field of an electronic cigarette, comprising an atomizer, a battery rod, and a connecting structure mounted at a butt-jointed position between the atomizer and the battery rod; the connecting structure includes a first connecting member mounted at an end of the atomizer and a second connecting member mounted at an end of the battery rod; a side surface of the first connecting member is provided with at least one snap that is capable of elastically moving inward along a radial direction of the atomizer, the second connecting member defines a butt-jointed slot configured for receiving the first connecting member, and a slot wall corresponding to the butt-jointed slot defines at least one snap-fit portion matching the snap. The electronic cigarette of the invention can prevent the used atomizer from being misused and repeatedly used.

13 Claims, 15 Drawing Sheets

ELECTRONIC CIGARETTE

CROSS-REFERENCE TO RELATED APPLICATIONS

This non-provisional application claims priorities under 35 U.S.C. §119(a) on Patent Application No. 201320447830.X filed in P.R. China on Jul. 25, 2013, the entire contents of which are hereby incorporated by reference.

FIELD OF THE INVENTION

This present invention relates to the field of electronic cigarettes, and more particularly to an electronic cigarette.

BACKGROUND OF THE INVENTION

An electronic cigarette generally comprises an atomizer and a battery rod. In the electronic cigarettes according to the prior art, most connection types between the atomizers and the battery rods are threaded connections. In assembly, a threaded connection needs to rotate many circles to be fixed stably. Thus, the production efficiency is low, the assembly is complicated, and it is not conducive to automatic production. Furthermore, because the atomizer and the battery rod can be repeatedly connected with each other for many times, it is difficult to distinguish a used atomizer from an unused atomizer, and an atomizer is easy to be used for many times. In many repeated using processes of an atomizer, a part of smoke may remain in the atomizer, and the smoke may generate off-flavor and be unhygienic when the atomizer is used next time.

SUMMARY OF THE INVENTION

The object of the present invention is to provide an electronic cigarette which can prevent the atomizer thereof from being used repeatedly for many times, thereby solving the problem that the atomizer of the aforementioned electronic cigarette in the prior art can be used for many times.

In order to realize the object mentioned above, an electronic cigarette is provided, The electronic cigarette comprises an atomizer, a battery rod, and a connecting structure mounted at a butt-jointed position between the atomizer and the battery rod; the connecting structure includes a first connecting member mounted at an end of the atomizer and a second connecting member mounted at an end of the battery rod; a side surface of the first connecting member is provided with at least one snap that is capable of elastically moving inward along a radial direction of the atomizer, the second connecting member defines a butt-jointed slot configured for receiving the first connecting member, and a slot wall corresponding to the butt-jointed slot defines at least one snap-fit portion matching the snap; in assembly, the snap is forced to be clamped in the snap-fit portion, and the atomizer is connected with the battery rod; in disassembly, the first connecting member and the second connecting member are respectively subjected to two forces along two opposite directions, the snap is broken, and the atomizer and the battery rod are disconnected from each other.

The snap-fit portion is an annular bulge formed by an end of the second connecting member extending inward along a radial direction of the battery rod.

The first connecting member further includes a buckle body connected with the snap and configured to fix the snap.

The buckle body includes a fixing part and a connecting part, one end of the connecting part axially extends from the fixing part, the other end of the connecting part is connected to the snap, and the snap protrudes from the connecting part along the radial direction of the atomizer.

The snap, the connecting part, and the fixed part are integrated.

The fixing part is ring-shaped, the first connecting member includes an outer electrode and an inner electrode coaxially sleeved inside the outer electrode, and the fixing part is clamped between the inner electrode and the outer electrode.

The first connecting member defines a motion space configured for enabling the snap to elastically move inward along the radial direction of the atomizer, and the motion space is a second groove defined in the outer electrode.

The fixing part is ring-shaped, the first connecting member is provided with an outer electrode, the outer electrode defines an annular groove in a circumference thereof, and the fixing part is embedded in the annular groove.

The first connecting member defines a motion space configured for enabling the snap to elastically move inward along the radial direction of the atomizer, and the motion space is a second groove defined in the outer electrode.

The fixing part is block-shaped, the first connecting member is provided with an outer electrode, an exterior of the outer electrode defines a first groove fitting the shape of the fixing part, and the fixing part is embedded in the first groove.

The first connecting member defines a motion space configured for enabling the snap to elastically move inward along the radial direction of the atomizer, and the motion space is a second groove defined in the outer electrode.

The connecting part is made from at least one material of rigid PVC, PC, PA, ABS, and PMMA.

The connecting part is bar-shaped, a length of the connecting part measured along the axial direction of the atomizer is greater than or equal to 0, and a thickness of the connecting part measured along the radial direction of the atomizer is 0.1 mm~0.5 mm.

One end surface of the snap facing the fixing part is a flat surface, and an angle between the flat surface and the connecting part is less than or equal to 90°.

One end of the snap facing the second connecting member forms a chamfer or a rounding.

An axial section of the snap is triangle.

By implementing the electronic cigarette of the present invention, the following advantages can be achieved: by means of mounting a plurality of snaps which can be broken by forces around a circumference of the first connecting member of the atomizer, when the first connecting member and the second connecting member are respectively subjected to two forces along two opposite directions, the snaps will be broken, and the atomizer and the battery rod will be disconnected from each other.

DETAILED DESCRIPTION OF THE PREFERRED EMBODIMENT

Figure 1:
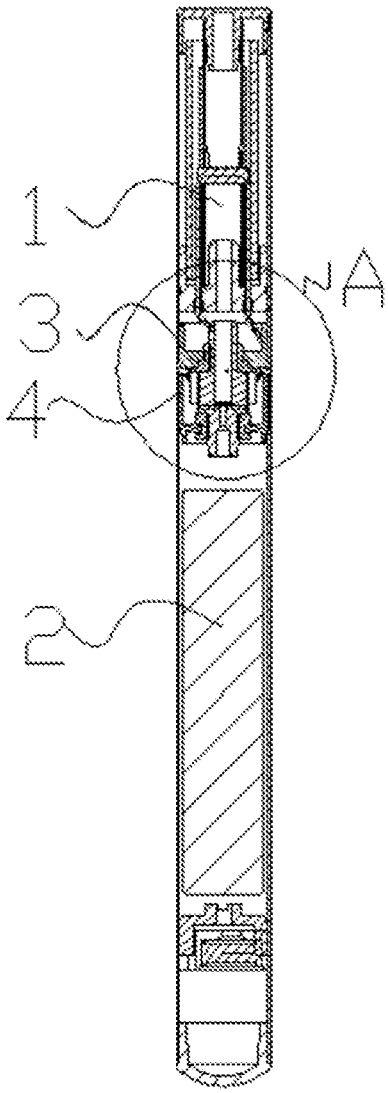
FIG. 1 is a whole structural schematic view of an electronic cigarette of a first embodiment of the present invention.
Figure 2:
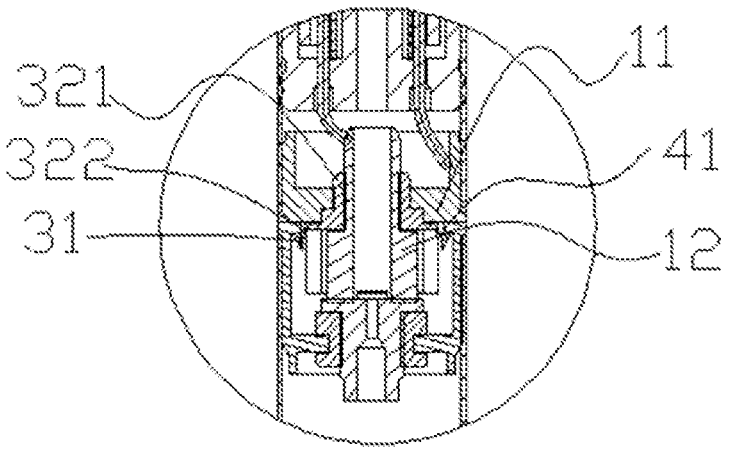
FIG. 2 is an enlarged view of the part A shown in FIG. 1.

In order to understand the technical features, the purpose and the effect of the present invention more clearly, the specific embodiments of the present invention will be described referring to the drawings.

Referring to FIGS. 1-15, an electronic cigarette provided by this invention comprises an atomizer 1, a battery rod 2, and a connecting structure mounted at a butt-jointed position between the atomizer 1 and the battery rod 2. The connecting structure includes a first connecting member 3 mounted at an end of the atomizer 1 and a second connecting member 4 mounted at an end of the battery rod 2. A side surface of the first connecting member 3 is provided with at least one snap 31, the second connecting member 4 defines a butt-jointed slot 40 configured for receiving the first connecting member 3, and a slot wall corresponding to the butt-jointed slot 40 defines at least one snap-fit portion 41 matching the snap 31. The snap 31 can elastically move inward along a radial direction of the atomizer 1 and can be broken by a force. In assembly, the snap 31 is forced to be clamped in the snap-fit portion 41 to connect the atomizer 1 with the battery rod 2. In disassembly, the first connecting member 3 and the second connecting member 4 are respectively subjected to two forces along two opposite directions, the snap 31 is broken, and the atomizer 1 and the battery rod 2 are disconnected from each other.

The snap 31 which can be broken by a force is adopted in this invention. In this way, when the atomizer 1 and the battery rod 2 are pulled away from each other after the electronic cigarette is used, the snap 31 is broken, and the atomizer 1 can't be used again. Thus, it is easy to distinguish a used atomizer 1 from an unused atomizer 1, and the used atomizer 1 is prevented from being repeatedly used for many times. A situation that a part of smoke remains in the atomizer 1 in many repeated using processes, which may cause smoke to generate off-flavor when the atomizer 1 is used next time and is unhygienic, is avoided.

It is understandable that a thread connecting member is generally used to connect the atomizer 1 with the battery rod 2 in the prior art. Compared with the snap 31, the thread connecting member is more complicated to manufacture and is inconvenient for mass production.

Preferably, the number of the snaps 31 is four, and these snaps 31 are uniformly distributed around a circumference of the first connecting member 3. In order to be produced conveniently, the snap-fit portion 41 is an annular bulge formed by an end of the second connecting member 4 extending inward along a radial direction of the battery rod 2. Additionally, an inner wall of the second connecting member 4 corresponding to the butt-jointed slot 40 can also define a groove, and the snap 31 is clamped in the groove to connect the atomizer 1 with the battery rod 2.

The first connecting member 3 further includes a buckle body connected with the snap 31 and configured for fixing the snap 31.

A particular structure of the buckle body is that the buckle body includes a fixing part 321 and a connecting part 322. One end of the connecting part 322 axially extends from the fixing part 321, and the other end of the connecting part 322 is connected to the snap 31. The snap 31 protrudes from the connecting part 322 along the radial direction of the atomizer 1, and is mounted at a side of the fixing part 321 near the battery rod 2. The snap 31, the connecting part 322, and the fixing part 321 are integrated. Generally, the snap 31 and the buckle body are formed by means of plastic injection molding.

In this invention, in order to buckle the snap 31 into the snap-fit portion 41 conveniently, one end of the snap 31 facing the second connecting part 4 forms a chamfer or a rounding. In the process of buckling the snap 31, the chamfer or the rounding of the end is first subjected to a force, the snap 31 is then forced to move inward along a radial direction of the atomizer 1, and the snap 31 is buckled into the snap-fit portion 41. Preferably, in this invention, an axial section of the snap 31 is triangular. In this invention, as the snap-fit portion 41 is an annular bulge formed by an end of the second connecting member 4 extending inward along a radial direction of the battery rod 2, a recess configured for fitly receiving the annular bulge therein is defined either between the snap 31 and the fixing part 321 or between a surface of the first connecting member 3 that is adjacent to the snap 31 and the snap 31. Thus, the atomizer 1 and the battery rod 2 can be prevented from moving toward each other along a collective axial direction of the atomizer 1 and the battery rod 2. It is understandable that, when the snap-fit portion 41 is a groove, the aforementioned recess is not needed to be defined. Alternatively, the snap-fit portion 41 can be a bottom edge of a lantern ring engaging with the butt-jointed slot 40, and the lantern ring and the butt-jointed slot 40 are connected with each other through an interference fit or clamping.

In order to disconnect the snap 31 from the buckle body conveniently, a thickness of the connecting part 322 should be small, and the connecting part 322 should be capable of withstanding a certain tension. In this invention, the connecting part 322 is bar-shaped, and a thickness of the connecting part 322 measured along the radial direction of the atomizer 1 is 0.1 mm~0.5 mm. Preferably, the thickness of the connecting part 322 measured along the radial direction of the atomizer 1 is 0.2 mm. The connecting part 322 is camber-shaped along a direction which is perpendicular to a length direction of the connecting part 322, and a radian range of the connecting part 322 is 5°~45°. Preferably, the radian of the connecting part 322 is 10°. A length of the connecting part 322 measured along the axial direction of the atomizer 1 should be greater than or equal to 0, so that a junction between the connecting part 322 and the snap 31 is facilitated to be broken by a tangential force. Meanwhile, for facilitating the connecting part 322 and the snap 31 to be broken away from each other, one end surface of the snap 31 facing the fixing part 321 is a flat surface, and an angle between the flat surface and the connecting part 322 is less than or equal to 90°; preferably, the angle is 90°. The connecting part 322 is made from at least one material of rigid PVC, PC, PA, ABS, and PMMA.

An integral structure formed by the buckle body and the snap 31 includes several embodiments as below:

Embodiment 1

Figure 3:
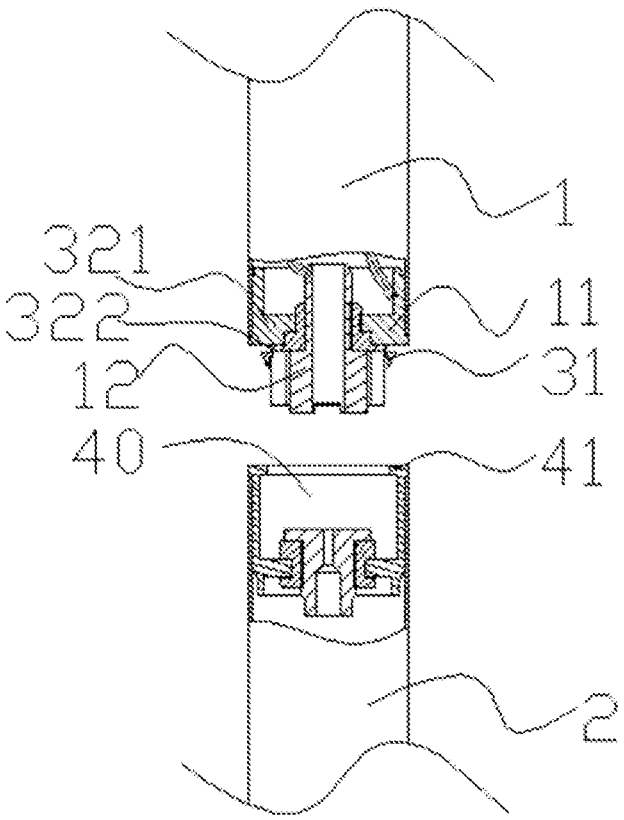
FIG. 3 is a partial schematic view of a disassembled structure of the electronic cigarette of the first embodiment of the present invention.
Figure 4:
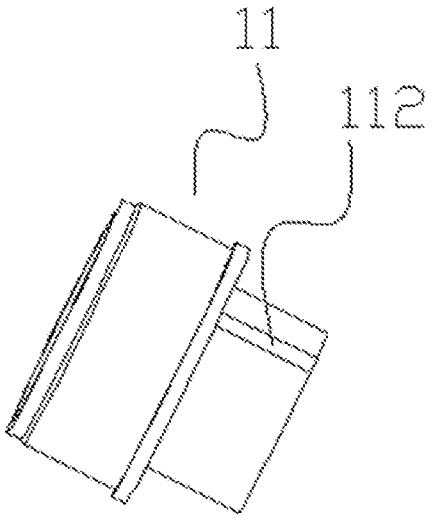
FIG. 4 is a structural schematic view of an outer electrode of the first embodiment of the present invention.
Figure 5:
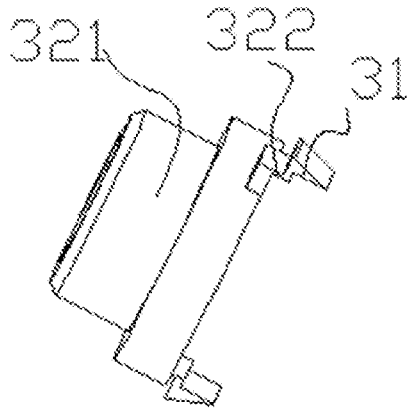
FIG. 5 is a structural schematic view of a buckle body and a snap of the first embodiment of the present invention.
Figure 6:
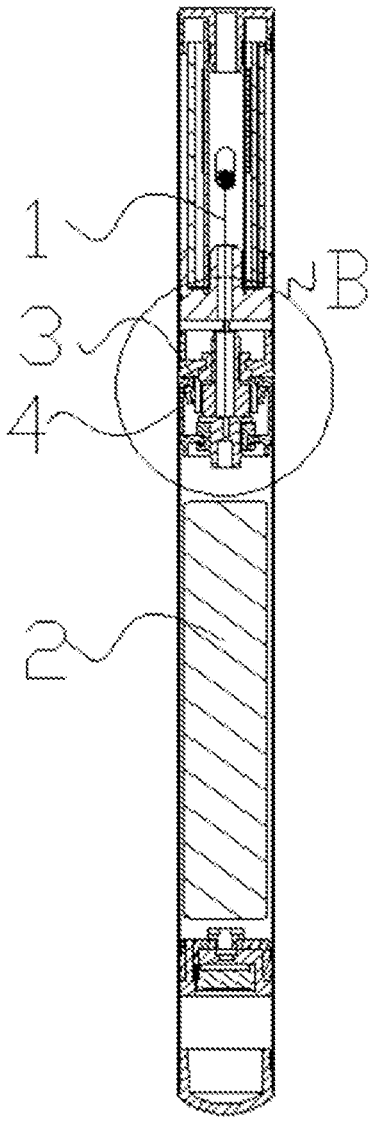
FIG. 6 is a whole structural schematic view of an electronic cigarette of a second embodiment of the present invention.
Figure 7:
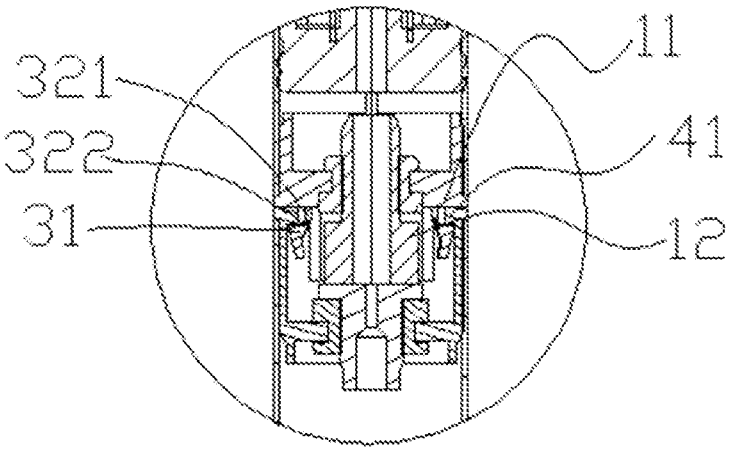
FIG. 7 is an enlarged view of the part B shown in FIG. 6.

Referring to FIG. 3, FIG. 4, and FIG. 5, the fixing part 321 is ring-shaped, the first connecting member 3 includes an outer electrode 11 and an inner electrode 12 coaxially sleeved inside the outer electrode 11, and the fixing part 321 is clamped between the inner electrode 12 and the outer electrode 11. The atomizer 1 includes an atomization sleeve, and the outer electrode 11 is inserted in the atomization sleeve to form an interference fit, so that the first connecting member 3 is fixed in the atomizer 1. The buckle body further has an insulating effect between the inner electrode 12 and the outer electrode 11. In order to fit the shape of the outer electrode 11, the fixing part 321 is stepped-shaft-shaped.

Embodiment 2

Figure 8:
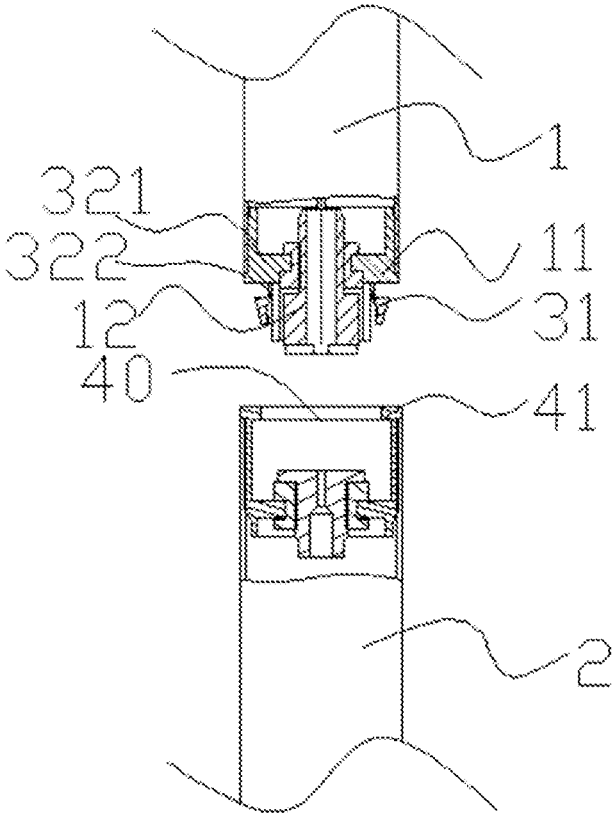
FIG. 8 is a partial schematic view of a disassembled structure of the electronic cigarette of the second embodiment of the present invention.
Figure 9:
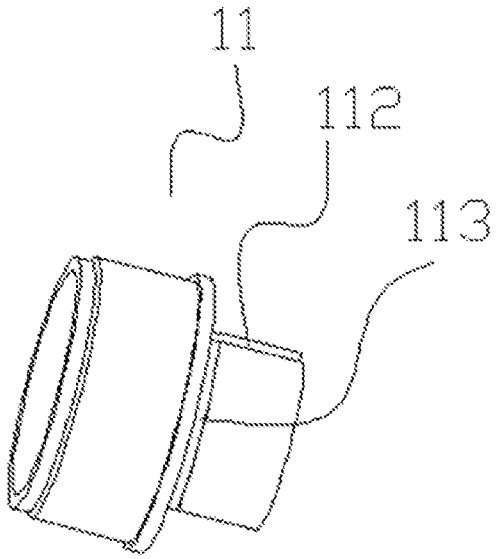
FIG. 9 is a structural schematic view of an outer electrode of the second embodiment of the present invention.
Figure 10:
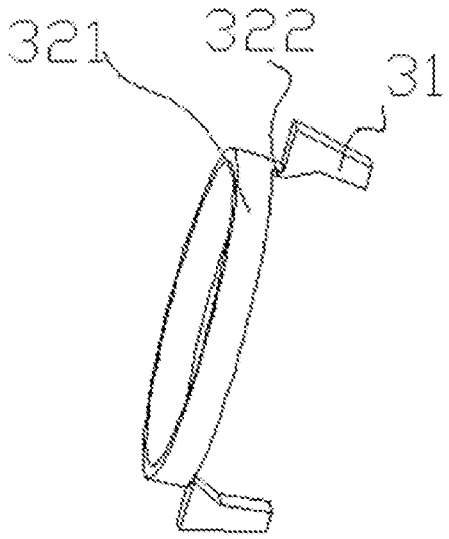
FIG. 10 is a structural schematic view of a buckle body and a snap-fit of the second embodiment of the present invention.
Figure 11:
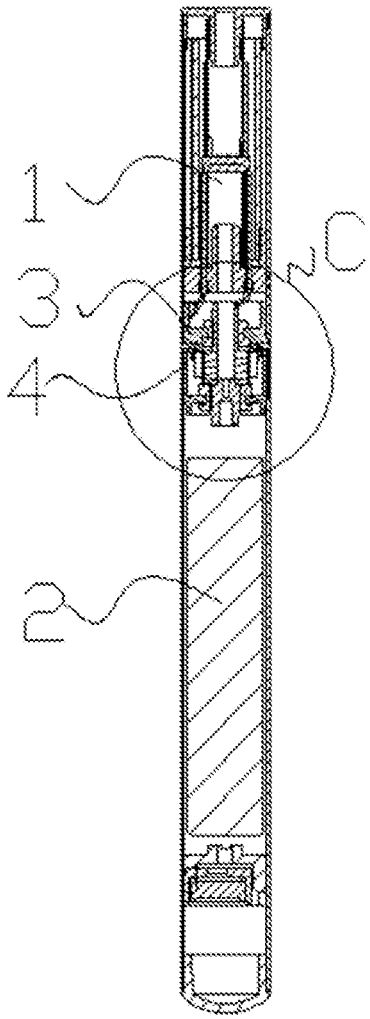
FIG. 11 is a whole structural schematic view of an electronic cigarette of a third embodiment of the present invention.
Figure 12:
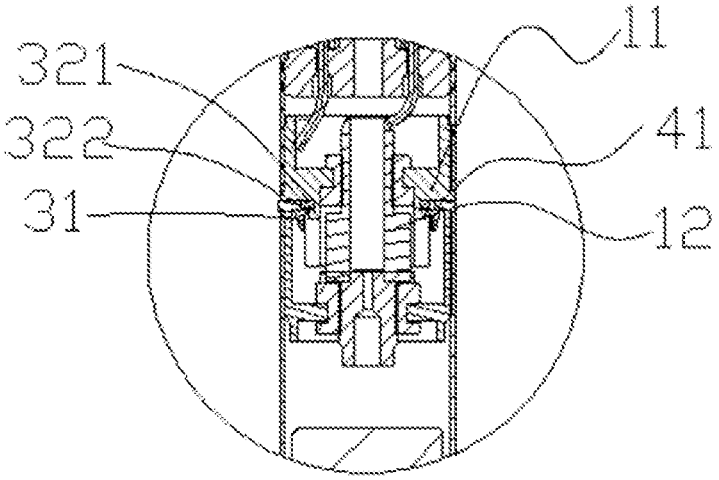
FIG. 12 is an enlarged view of the part C shown in FIG. 11.

Referring to FIG. 8, FIG. 9, and FIG. 10, the fixing part 321 is ring-shaped, the first connecting member 3 is provided with an outer electrode 11, an annular groove 113 is defined around a circumference of the outer electrode 11, and the fixing part 321 is embedded in the annular groove 113. As same as the first embodiment, the atomizer 1 includes an atomization sleeve; the outer electrode 11 is inserted in the atomization sleeve to form a interference fit, so that the first connecting member 3 is fixed in the atomizer 1; and the first connecting member 3 further includes an inner electrode 12 coaxially sleeved inside the outer electrode 11. However, a difference between the first embodiment and the second embodiment is that: in the second embodiment, an insulating member is arranged between the outer electrode 11 and the inner electrode 12, and the buckle body does not have the insulating effect between the inner electrode 12 and the outer electrode 11.

Embodiment 3

Figure 13:
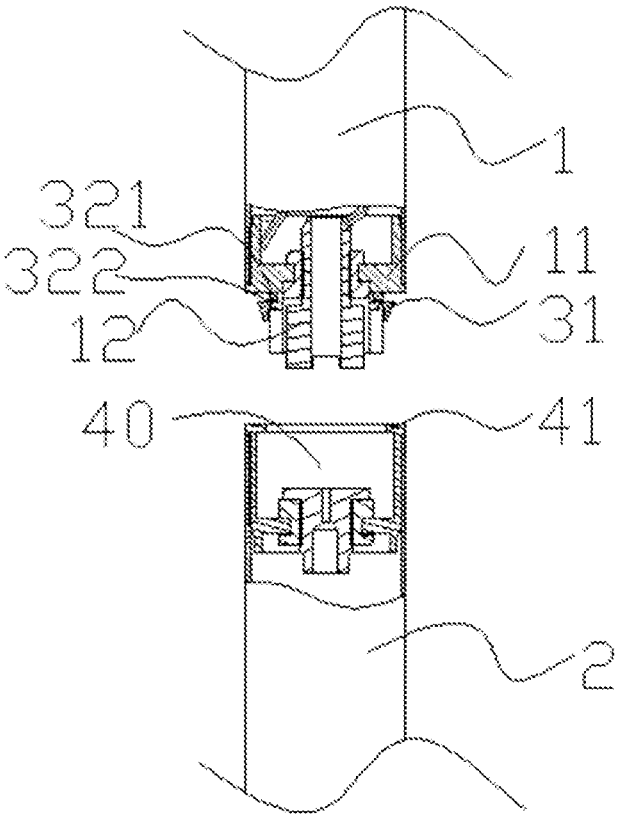
FIG. 13 is a partial schematic view of a disassembled structure of the electronic cigarette of the third embodiment of the present invention.
Figure 14:
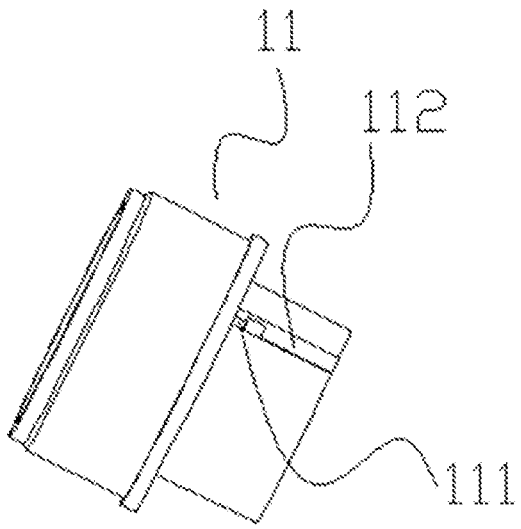
FIG. 14 is a structural schematic view of an outer electrode of the third embodiment of the present invention.
Figure 15:
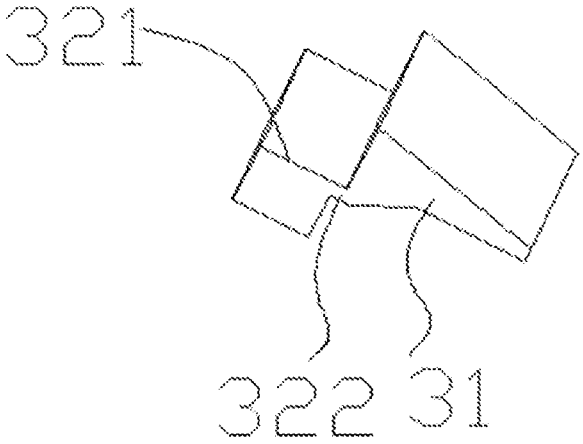
FIG. 15 is a structural schematic view of a buckle body and a snap-fit of the third embodiment of the present invention.

Referring to FIG. 13, FIG. 14, and FIG. 15, the fixing part 321 is block-shaped, the first connecting member 3 is provided with an outer electrode 11, an exterior of the outer electrode 11 defines a first groove 111 fitting the shape of the fixed part 321, and the fixing part 321 is embedded in the first groove 111. In the aforementioned first and second embodiments, a plurality of snaps 31 is mounted on one buckle body. In the third embodiment, the buckle body and the snap 31 form one-to-one correspondence. As sane as the second embodiment, the atomizer 1 includes an atomization sleeve; the outer electrode 11 is inserted in the atomization sleeve to form an interference fit, so that the first connecting member 3 is fixed in the atomizer 1; the first connecting member 3 further includes an inner electrode 12 coaxially sleeved inside the outer electrode 11; and an insulating member is arranged between the outer electrode 11 and the inner electrode 12.

In the aforementioned three embodiments, the outer electrode 11 and the inner electrode 12 are respectively electrically connected to the two electrodes of the battery rod, and are respectively electrically connected to two ends of an atomization component of the atomizer 1. The first connecting member 3 defines a motion space configured for enabling the snap 31 to elastically move inward along the radial direction of the atomizer 1, and the motion space is a second groove 112 defined in the outer electrode 11. The snap 31 and the buckle body is merely manufactured through plastic injection molding, and the process applied to corresponding positions of the first connecting member 3 and the second connecting member 4 is also less. Compared with machine processing of connecting members for electronic cigarettes in the prior art, in this invention, the first connecting member 3 and the second connecting member 4 are facilitated to manufacture and fit for mass production.

In conclusion, by using the snap 31 which can be broken away from the buckle body under forces, once the atomizer 1 and the battery rod 2 are stressed after use, the snap 31 will be broken away from the buckle body. In this way, the atomizer 1 can't be used again, and will be effectively prevented from being repeatedly used for many times.

The present invention has been described with the drawings to the embodiments, while the present invention is not limit to the aforementioned specific embodiments and the specific embodiments are merely a hint rather than a limit. It will be understood by those skilled in the art that various changes may be made and equivalents may be substituted without departing from the purpose of the invention and the scope of the claims, but all the changes will be included within the scope of the appended claims.

What is claimed is:

1. An electronic cigarette, comprising an atomizer, a battery rod, and a connecting structure mounted at a butt-jointed position between the atomizer and the battery rod; wherein, the connecting structure includes a first connecting member mounted at an end of the atomizer and a second connecting member mounted at an end of the battery rod; a side surface of the first connecting member is provided with at least one snap that is capable of elastically moving inward along a radial direction of the atomizer, the second connecting member defines a butt-jointed slot configured for receiving the first connecting member, and a slot wall corresponding to the butt-jointed slot defines at least one snap-fit portion matching the snap;

wherein in assembly, the snap is forced to be clamped in the snap-fit portion, and the atomizer is connected with the battery rod;

wherein in disassembly, the first connecting member and the second connecting member are respectively subjected to two forces along two opposite directions, the snap is broken, and the atomizer and the battery rod are disconnected from each other;

wherein the first connecting member further includes a buckle body connected with the snap and configured to fix the snap;

wherein the buckle body includes a fixing part and a connecting part, one end of the connecting part axially extends from the fixing part, the other end of the connecting part is connected to the snap, and the snap protrudes from the connecting part along a radial direction of the atomizer.

2. The electronic cigarette of claim 1, wherein the snap, the connecting part, and the fixed part are integrated.

3. The electronic cigarette of claim 1, wherein the fixing part is ring-shaped, the first connecting member includes an outer electrode and an inner electrode coaxially sleeved inside the outer electrode, and the fixing part is clamped between the inner electrode and the outer electrode.

4. The electronic cigarette of claim 3, wherein the first connecting member defines a motion space configured for enabling the snap to elastically move inward along the radial direction of the atomizer, and the motion space is a second groove defined in the outer electrode.

5. The electronic cigarette of claim 1, wherein the fixing part is ring-shaped, the first connecting member is provided with an outer electrode, the outer electrode defines an annular groove in a circumference thereof, and the fixing part is embedded in the annular groove.

6. The electronic cigarette of claim 5, wherein the first connecting member defines a motion space configured for enabling the snap to elastically move inward along the radial direction of the atomizer, and the motion space is a second groove defined in the outer electrode.

7. The electronic cigarette of claim 1, wherein the fixing part is block-shaped, the first connecting member is provided with an outer electrode, an exterior of the outer electrode defines a first groove fitting the shape of the fixing part, and the fixing part is embedded in the first groove.

8. The electronic cigarette of claim 7, wherein the first connecting member defines a motion space configured for enabling the snap to elastically move inward along the radial direction of the atomizer, and the motion space is a second groove defined in the outer electrode.

9. The electronic cigarette of claim 1, wherein the connecting part is made from at least one material of rigid PVC, PC, PA, ABS material, and PMMA.

10. The electronic cigarette of claim 1, wherein the connecting part is bar-shaped, a length of the connecting part measured along the axial direction of the atomizer is greater than or equal to 0, and a thickness of the connecting part measured along the radial direction of the atomizer is 0.1 mm~0.5 mm.

11. The electronic cigarette of claim 1, wherein one end surface of the snap facing the fixing part is a flat surface, and an angle between the flat surface and the connecting part is less than or equal to 90°.

12. The electronic cigarette of claim 1, wherein one end of the snap facing the second connecting member forms a chamfer or a rounding.

13. The electronic cigarette of claim 12, wherein an axial section of the snap is triangular.

* * * * *